US009359977B2

(12) United States Patent
Brock et al.

(10) Patent No.: US 9,359,977 B2
(45) Date of Patent: Jun. 7, 2016

(54) FUEL VAPOR RECOVERY CANISTER

(71) Applicant: Stant USA Corp., Connersville, IN (US)

(72) Inventors: Michael S Brock, Connersville, IN (US); John C Long, II, Auburn Hills, MI (US); Sukhjit Singh, Windsor (CA)

(73) Assignee: Stant USA Corp., Connersville, IN (US)

( * ) Notice: Subject to any disclaimer, the term of this patent is extended or adjusted under 35 U.S.C. 154(b) by 204 days.

(21) Appl. No.: 14/185,580

(22) Filed: Feb. 20, 2014

(65) Prior Publication Data

US 2014/0230796 A1 Aug. 21, 2014

Related U.S. Application Data

(60) Provisional application No. 61/767,177, filed on Feb. 20, 2013.

(51) Int. Cl.
*F02M 25/08* (2006.01)

(52) U.S. Cl.
CPC ..... *F02M 25/0854* (2013.01); *F02M 25/0836* (2013.01); *F02M 25/0872* (2013.01)

(58) Field of Classification Search
CPC ..... F02M 25/0836; F02M 25/0854; F02M 25/0872
USPC ..... 123/519, 520
See application file for complete search history.

(56) References Cited

U.S. PATENT DOCUMENTS

| | | | | |
|---|---|---|---|---|
| 5,337,721 | A * | 8/1994 | Kasuya | F02M 25/0854 123/519 |
| 5,460,136 | A * | 10/1995 | Yamazaki | F02M 25/0854 123/519 |
| 5,564,398 | A * | 10/1996 | Maeda | F02M 25/0854 123/519 |
| 6,481,592 | B2 | 11/2002 | Harris | |
| 6,537,354 | B2 * | 3/2003 | Meiller | F02M 25/0854 123/519 |
| 6,874,483 | B2 * | 4/2005 | Zuchara | B01D 53/0415 123/519 |
| 7,228,850 | B2 | 6/2007 | King | |
| 7,409,946 | B2 | 8/2008 | King | |
| 7,472,964 | B2 | 1/2009 | King | |
| 7,527,040 | B2 | 5/2009 | Couch | |
| 8,215,290 | B2 | 7/2012 | Dunkle et al. | |
| 2004/0173190 | A1 * | 9/2004 | Makino | F02D 41/004 123/520 |
| 2009/0139495 | A1 | 6/2009 | Crawford | |

OTHER PUBLICATIONS

International Search Report and Written Opinion of the International Search Report for International Application No. PCT/US2014/017425, Jun. 6, 2014, 10 pages.

* cited by examiner

*Primary Examiner* — Lindsay Low
*Assistant Examiner* — Robert Werner
(74) *Attorney, Agent, or Firm* — Barnes & Thornburg LLP

(57) ABSTRACT

A vehicle fuel system includes a vapor recovery canister containing at least two carbon beds. Each carbon bed is configured to capture hydrocarbon material associated with fuel vapor discharged from a vehicle fuel tank into the canister.

20 Claims, 6 Drawing Sheets

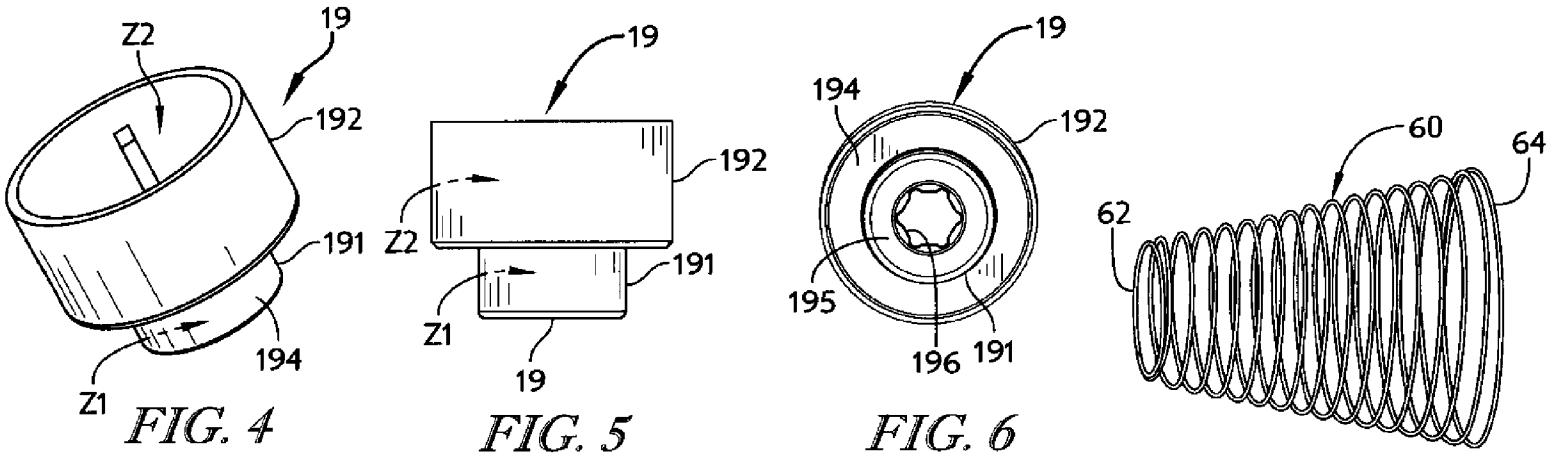
FIG. 4
FIG. 5
FIG. 6
FIG. 9
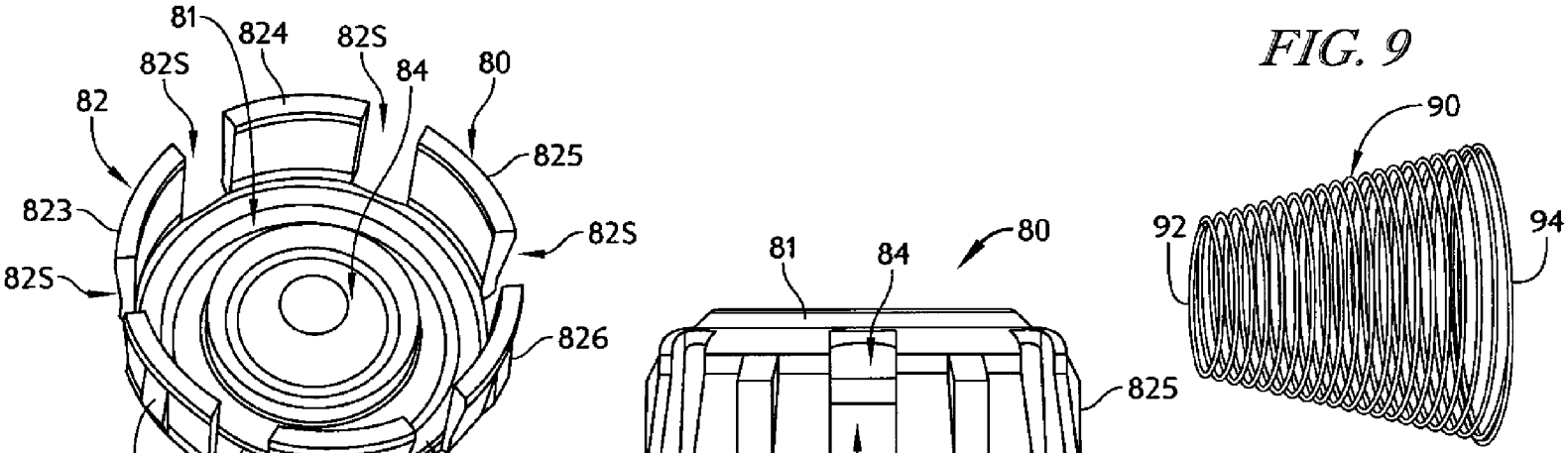
FIG. 10
FIG. 8
FIG. 7

U-FLOW CANISTER PICTURE WITH THREE CARBON BEDS

FUEL VAPOR RECOVERY CANISTER

PRIORITY CLAIM

This application claims priority under 35 U.S.C. §119(e) to U.S. Provisional Application Ser. No. 61/767,177, filed Feb. 20, 2013, which is expressly incorporated by reference herein.

BACKGROUND

The present disclosure relates to a vehicle fuel system, and particularly to a fuel vapor venting system associated with a vehicle fuel tank. More particularly, the present disclosure relates to a fuel vapor recovery canister included in a fuel vapor venting system.

Vehicle fuel systems are configured to vent pressurized or displaced fuel vapor from the vapor space in the fuel tank to a separate charcoal canister. The canister is designed to capture and store hydrocarbons entrained in fuel vapors that are displaced and generated in the fuel tank and then discharge filtered air from the canister to the atmosphere.

When a vehicle engine is running, a purge vacuum is applied to the charcoal canister via the engine intake manifold. Hydrocarbons stored (e.g., adsorbed) on charcoal held in the canister are entrained in a stream of atmospheric air drawn into the canister by the purge vacuum. This produces a stream of fuel vapor laden with reclaimed hydrocarbon material that is discharged through a purge hose into the intake manifold for combustion in the engine.

A large volume of fuel vapor is vented from the fuel tank into the canister during fuel tank refueling when the engine is off. A relatively smaller volume of fuel vapor is vented from the fuel tank into the canister when the engine is on and a purge vacuum is applied to the charcoal held in the canister to draw air from the atmosphere into the carbon bed.

SUMMARY

A canister system in accordance with the present disclosure includes charcoal contained in a filter bed housing. The filter bed housing includes an inlet adapted to be coupled to a tank vent control system coupled to a fuel tank and to an intake manifold coupled to a vehicle engine. The filter bed housing also includes an outlet adapted to communicate with atmospheric air located outside of the canister.

In illustrative embodiments, the canister system includes first and second carbon beds located in spaced-apart relation to one another inside the filter bed housing and a vapor flow controller comprising a two-stage bleed emissions flow-control valve located in a space provided in the filter bed housing between the first and second carbon beds. The first carbon bed is located near to a canister inlet formed in the filter bed housing while the second carbon bed is located near to a canister outlet formed in the filter bed housing. In illustrative embodiments, the vapor flow controller further comprises a valve housing lying between the first and second carbon beds and containing the flow-control valve in a valve chamber formed in the valve housing.

The flow-control valve included in illustrative embodiments of the canister system comprises a spring-loaded pressure-relief valve and a spring-loaded vacuum-relief valve. The flow-control valve is configured to assume a normally closed position. The flow-control valve is configured to open at the proper time when exposed to pressures and vacuums in excess of predetermined levels. This will reduce the atmospheric discharge of bleed emissions from the fuel tank through the canister system to the atmosphere. When the flow-control valve is closed, small amounts of pressurized fuel vapor from the fuel tank (i.e., bleed emissions) cannot pass through the valve chamber formed in the valve housing from the first carbon bed to the second carbon bed and then to the atmosphere through the canister outlet. It is therefore unnecessary to couple a separate downstream bleed emissions-capturing honeycomb scrubber to the canister outlet to intercept and treat bleed emissions that would otherwise exit to the atmosphere.

In the normally closed position, the flow-control valve in illustrative embodiments may include a calibrated bypass to discharge a controlled small volume of filtered air through the canister outlet to the atmosphere. Such a limited controlled discharge of pressurized fuel vapor from the first carbon bed to the second carbon bed and then to the atmosphere through the canister outlet operates to block the buildup of too much pressure in the canister system.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 4 is a reduced-size perspective view of the valve housing of FIG. 3;

FIG. 5 is a side elevation view of the valve housing of FIG. 4;

FIG. 6 is a bottom view of the valve housing of FIG. 4;

FIG. 7 is a perspective view of the underside of the vacuum-relief valve of FIG. 3;

FIG. 8 is a side elevation view of the vacuum-relief valve of FIG. 7;

FIG. 9 is a perspective view of the pressure-relief control spring of FIGS. 1-3;

FIG. 10 is a perspective view of the vacuum-relief control spring of FIGS. 1-3;

DETAILED DESCRIPTION

Figure 1:
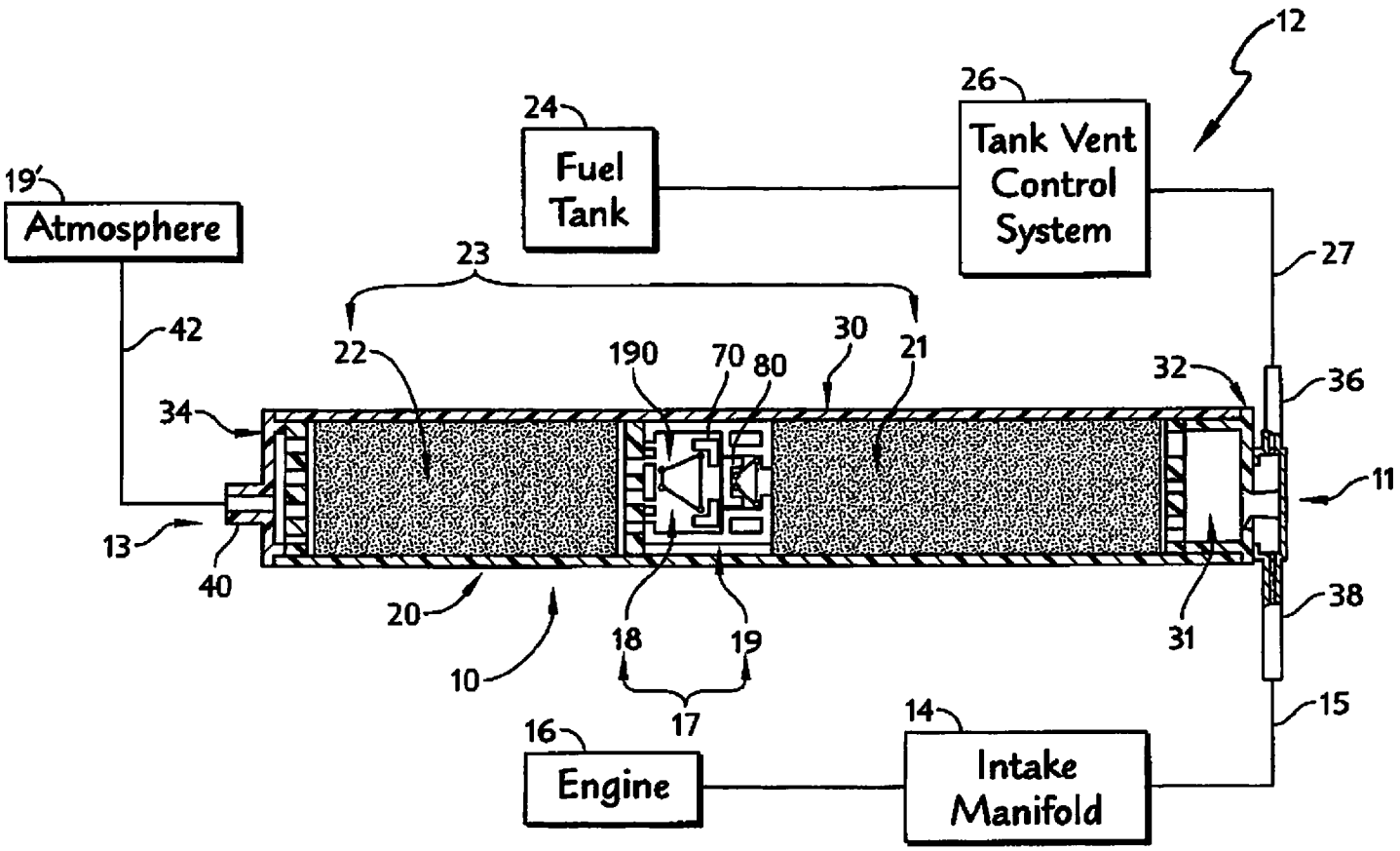
FIG. 1 is a diagrammatic view of a vehicle fuel system including a sectional view of a canister system in accordance with the present disclosure and showing that the canister system includes a two-stage bleed emissions flow-control valve located in a valve housing positioned to lie between first and second carbon beds to provide a vapor flow controller between the carbon beds and showing that the first carbon bed is located near a canister inlet coupled to a tank vent control system and to an engine intake manifold and that the second carbon bed is located near an opposite canister outlet coupled to the atmosphere.
Figure 19:
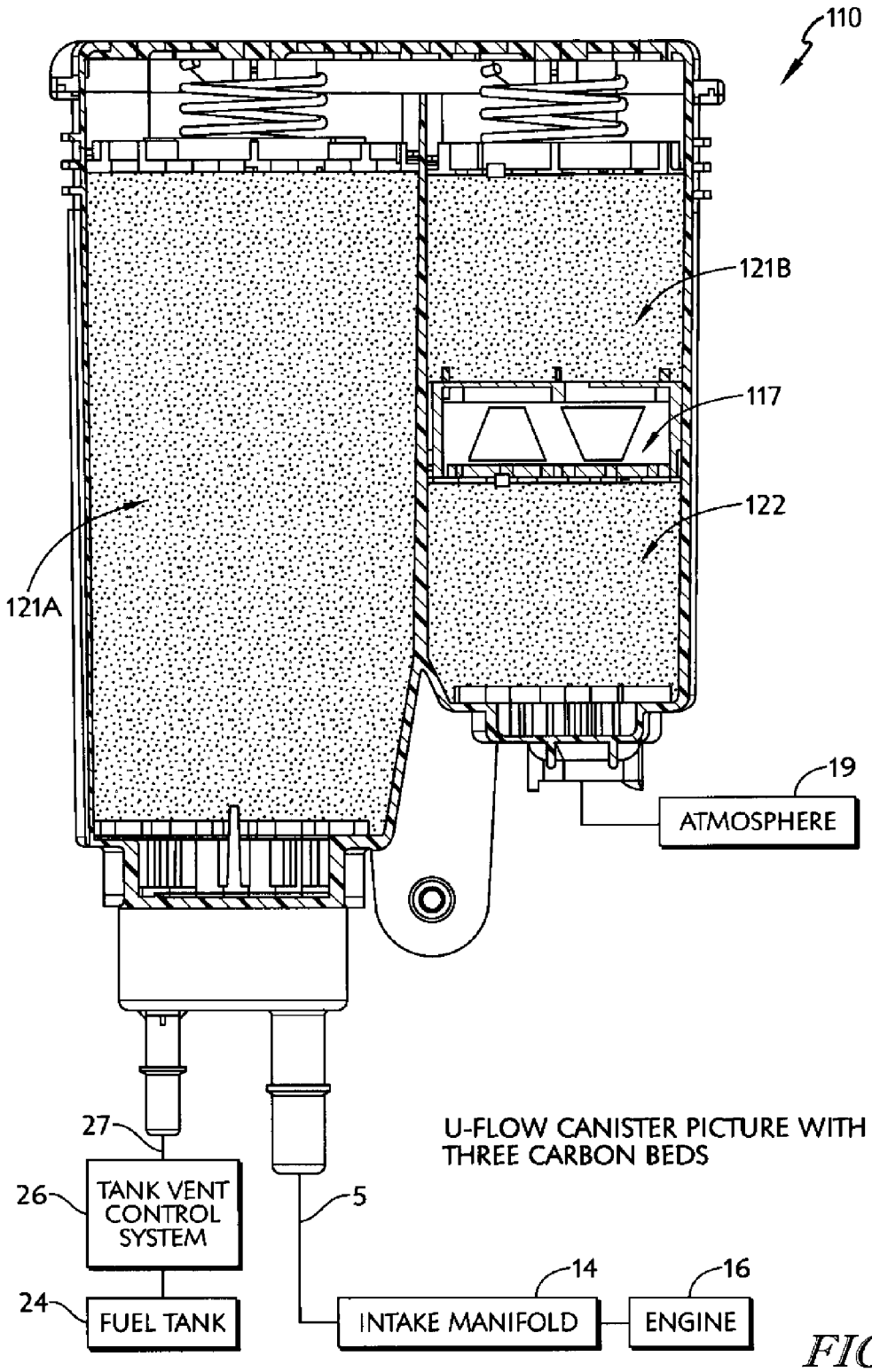
FIG. 19 is a diagrammatic view of a canister system in accordance with another embodiment of the present disclosure wherein three carbon beds are used.

A fuel vapor recovery canister 10 is included in a vehicle fuel system 12 associated with a vehicle having an intake manifold 14 communicating with canister 10 and an engine 16 coupled to intake manifold 14 as suggested diagrammatically in FIG. 1. Canister 10 has a filter bed housing 20 containing a modular vapor flow controller 17 and a hydrocarbon filter 23 comprising first and second carbon beds 21, 22. Canister 10 is configured to clean fuel vapor vented from fuel tank 24 during, for example, tank refueling. Canister 10 is cleaned or purged using a vacuum provided by intake manifold 14 when engine 16 is running. An alternative fuel vapor recovery canister 110 comprising three carbon beds 121A, 121B, and 122 and a modular vapor flow controller 117 is shown in FIG. 19.

Figure 3:
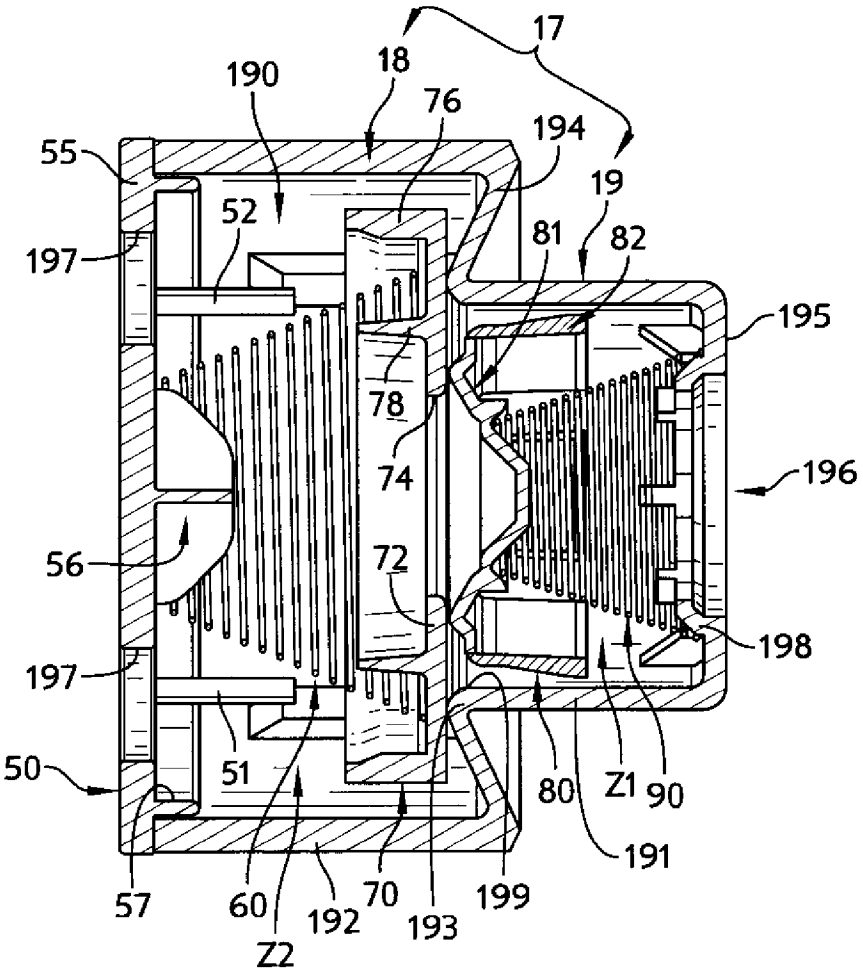
FIG. 3 is a sectional view of an assembled vapor flow controller of the type shown in FIG. 1 showing that the flow-control valve is mounted in a valve chamber formed in a valve housing and is arranged to assume a normally closed position in which the pressure-relief valve is yieldably urged to the right to mate with an annular valve seat formed in the valve housing to close a vapor discharge aperture bounded by the annular valve seat formed in the valve housing and the vacuum-relief valve is yieldably urged to the left to mate with the pressure-relief valve to close a vapor intake aperture formed in the pressure-relief valve.

Vapor flow controller 17 includes a flow-control valve 18 and a valve housing 19 is shown, for example, in FIGS. 1 and 3. Vapor flow controller 17 is positioned to lie in a space (i.e., flow-controller compartment) provided between first and second carbon beds 21, 22 of hydrocarbon filter 23 as suggested in FIG. 1. Vapor flow controller 17 is a two-stage device that is operable to open (1) to allow pressurized fuel vapor to flow from first carbon bed 21 to second carbon bed 22 to deposit hydrocarbons entrained in the fuel vapor on carbon beds 21, 22 during tank refueling and (2) to allow air from the atmosphere 19' to be drawn through second and first carbon beds 22, 21 and then into engine 16 during a canister (hydrocarbon) purge cycle to purge hydrocarbons that had been stored on carbon beds 22, 21 so that those hydrocarbons can pass through intake manifold 14 and then be burned in engine 16.

A tank vent control system 26 is configured to conduct fuel vapor discharged from fuel tank 24 into a fuel vapor recovery canister 10 through a canister inlet 11 as suggested in FIG. 1. It is within the scope of this disclosure to use any suitable system of conduits and valves to produce a system to conduct fuel vapor from fuel tank 24 to canister 10 to be cleaned as the fuel vapor passes through first and second carbon beds 21, 22 included in canister 10, and filtered air is discharged from canister 10 through a canister outlet 13 to the atmosphere 19'.

In use, hydrocarbon material (not shown) entrained in fuel vapor discharged from fuel tank 24 into canister 10 through canister inlet 13 and passed through first and second carbon beds 21, 22 of hydrocarbon filter 23 is captured or stored (e.g., adsorbed) on charcoal granules included in carbon beds 21, 22. Therefore, hydrocarbon material is removed from fuel vapor as that fuel vapor passes through first and second carbon beds 21, 22 of hydrocarbon filter 23 and a stream of cleaned vapor is discharged from canister 10 to the atmosphere 19' during a vapor-cleaning process that can occur during tank-refueling activities and during normal engine operation.

Filter bed housing 20 includes a tube 30, an inlet cover 32 formed to include canister inlet 11 and coupled to one end of tube 30, and an outlet cover 34 formed to include canister outlet 13 and coupled to an opposite end of tube 30 as shown, for example, in FIG. 1. Tube 30 is formed to include an interior region 31 arranged to communicate with canister inlet 11 and canister outlet 13 as suggested in FIG. 1. First carbon bed 21 is arranged to lie in an upstream portion of interior region 31 and second carbon bed 22 is arranged to lie in a downstream portion of interior region 31 as suggested in FIG. 1.

Inlet cover 32 includes a fuel vapor port 36 coupled to conduit 27 to admit fuel vapor discharged from fuel tank 24 into canister 10 via tank vent control system 26 during a tank-refueling cycle (and sometimes during normal engine operation). Inlet cover 32 also includes a vacuum port 38 coupled to a conduit 15 leading to intake manifold 14 to apply a vacuum provided via intake manifold 14 to an interior region 31 formed in tube 30 during a canister-purge cycle. Fuel vapor port 36 and vacuum port 38 cooperate to define canister inlet 11 in an illustrative embodiment of the present disclosure.

Outlet cover 34 includes an air port 40 coupled to conduit 42 to discharge cleaned vapor from canister 10 to atmosphere 19' during the tank-refueling cycle. Air port 40 is configured to define canister outlet 11 in the illustrated disclosure.

First carbon bed 21 of hydrocarbon filter 23 comprises a first group of carbon granules as suggested in FIG. 1. It is within the scope of this disclosure to provide any suitable means for retaining these carbon granules in a packed arrangement in an upstream portion of interior region 31 of tube 30 near inlet cover 32 and canister inlet 11 and between vapor flow controller 17 and canister inlet 11 to expose those carbon granules to vapor flowing through interior region 31 between inlet and outlet covers 32, 34. It is within the scope of the present disclosure to divide first carbon bed 21 into two or more beds to help with adsorption and bleed emission.

Second carbon bed of hydrocarbon filter 23 comprises a second group of carbon granules as suggested in FIG. 1. It is within the scope of this disclosure to provide any suitable means for retaining the carbon granules in a packed arrangement in a downstream portion of interior region 31 of the tube near outlet cover 34 and canister outlet 13 between vapor flow controller 17 and canister outlet 11 and in spaced-apart relation to carbon granules in first carbon bed 21 to expose the carbon granules in second carbon bed 22 to vapor flowing through interior region 31 between inlet and outlet covers 32, 34.

Vapor flow controller 17 is positioned in interior region 31 of tube 30 to lie between first and second carbon beds 21, 22 as shown, for example, in FIG. 1. Valve housing 19 of vapor flow controller 17 is interposed between first and second carbon beds 21, 22 and formed to include a valve chamber 190 through which vapor flows as it is conducted through the space provided in interior region 31 between first and second carbon beds 21, 22 and occupied by vapor flow controller 17. Flow-control valve 18 of vapor flow controller 17 is positioned to lie in valve chamber 190 of valve housing 19 and regulate the flow of vapor therethrough in response to exposure to positive and negative pressure levels extant in first carbon bed 21.

Figure 2:
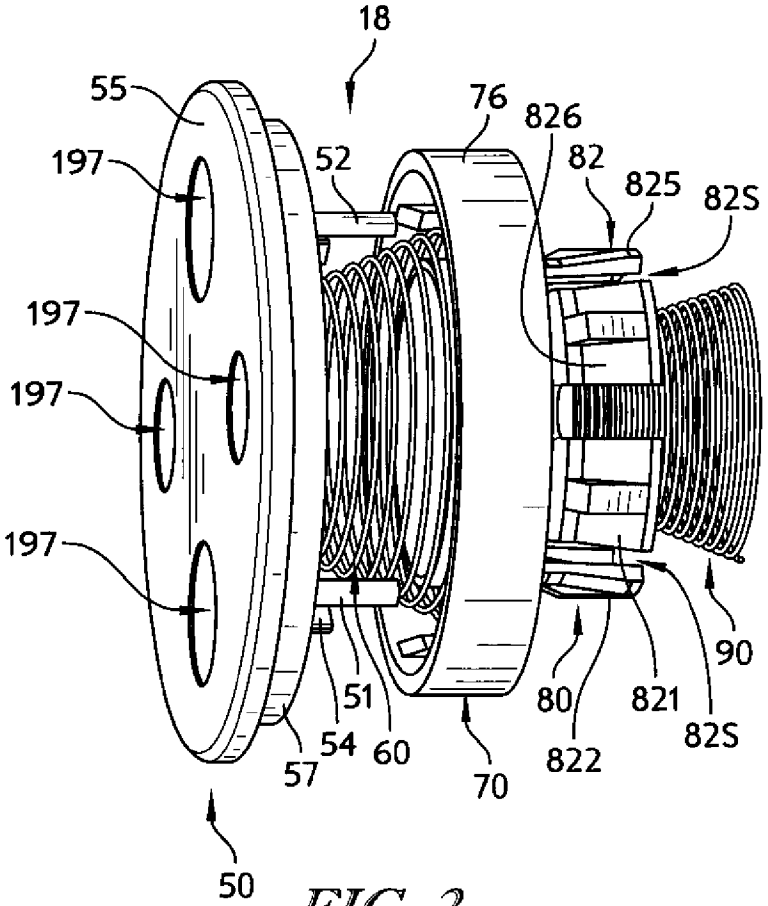
FIG. 2 is an enlarged perspective view of several components included in the flow-control valve of FIG. 1 showing (from left to right) a perforated retainer, a pressure-relief control spring, a pressure-relief valve, a vacuum-relief valve, and a vacuum-relief control spring before they are positioned to lie in a valve chamber formed in a valve housing shown in FIG. 3.

Flow-control valve 18 includes a perforated retainer 50, a pressure-relief control spring 60, a pressure-relief valve 70, a vacuum-relief valve 80, and a vacuum-relief control spring 90 as shown, for example, in FIG. 2. When assembled, pressure-relief control spring 60 is arranged to act against perforated retainer 50 to urge pressure-relief valve 70 normally toward vacuum-relief control spring 90 to a normally closed position engaging an annular valve seat 193 included in valve housing 19 to close a vapor discharge aperture 199 defined by annular valve seat 193 as suggested in FIG. 3. When assembled, vacuum-relief control spring 90 is arranged to act against a valve mount 195 included in valve housing 19 to urge vacuum-relief valve 80 normally toward pressure-relief control spring 60 to a normally closed position engaging pressure-relief valve 70 and closing a vapor intake aperture 72 formed in pressure-relief valve 70 as also suggested in FIG. 3.

Valve housing 19 includes a small-diameter sleeve 191 configured to define a first-bed zone Z1 in valve chamber 190 and a large-diameter sleeve 192 coupled to perforated retainer 50 and configured to define a second-bed zone Z2 in valve chamber 190 as suggested in FIG. 3. Valve housing 19 also includes a frustoconical plate 194 arranged to interconnect inner ends of sleeves 191, 192 and define the annular valve seat 193 associated with pressure-relief valve 70 as shown, for example, in FIG. 3. Frustoconical plate 194 is arranged to cause annular valve seat 193 to be surrounded by large-diameter sleeve 192 and to face toward perforated retainer 50 as suggested in FIG. 3.

Valve housing 19 also includes a small-diameter plate 195 coupled to an outer end of small-diameter sleeve 191 and formed to include a central first-bed vent aperture 196 opening into first-bed zone Z1 of valve chamber 190 and lying adjacent to and in fluid communication with first carbon bed 21 as suggested in FIGS. 1 and 3. Small-diameter plate 195 defines a spring mount 198 against which vacuum-relief control spring 90 acts as suggested in FIG. 3.

Figure 15:
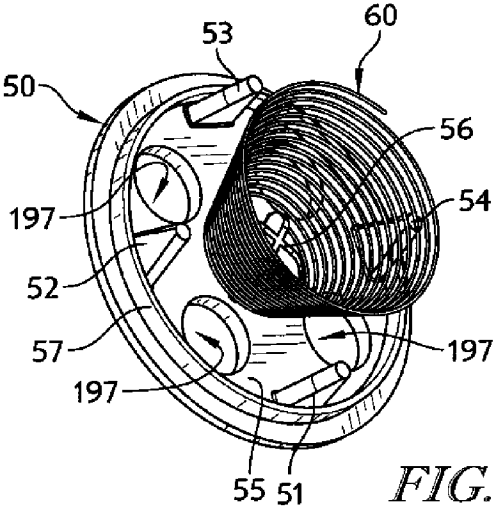
FIG. 15 is a perspective view showing mating engagement of the pressure-relief control spring of FIG. 9 with the underside of the perforated plate included in the perforated retainer of FIG. 11.

Perforated retainer 50 of flow-control valve 18 is coupled to an outer end of large-diameter sleeve 192 of valve housing 19 as suggested in FIG. 3. Perforated retainer 50 is formed to include four second-bed vent apertures 197 opening into second-bed zone Z2 of valve chamber 190 formed in valve housing 19 and lying adjacent to and in fluid communication with second carbon bed 22 as suggested in FIGS. 1 and 3. Perforated retainer 50 defines a spring mount 56 against which pressure-relief control spring 60 acts as suggested in FIGS. 3 and 15.

Figure 11:
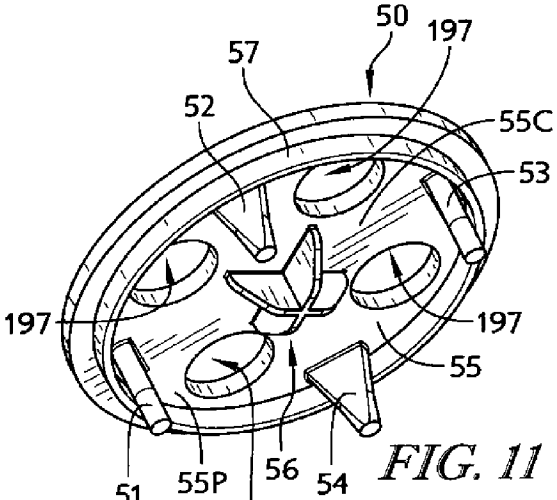
FIG. 11 is a perspective view of the retainer of FIGS. 1-3 showing that the perforated retainer included in the flow-control valve of FIG. 2 includes a perforated plate formed to include four second-bed vent apertures, a cross-shaped spring mount coupled to the underside of the perforated plate, and four valve standoffs coupled to the underside of the perforated plate and arranged to surround the cross-shaped spring mount.

Perforated retainer 50 includes a perforated plate 55, a cross-shaped spring mount 56 coupled to the underside of perforated plate 55 and arranged to extend toward pressure-relief valve 70, and four valve standoffs 51-54 coupled to the underside of perforated plate 55 and arranged to surround cross-shaped spring mount 56 as suggested in FIG. 11. A circular rim 57 is coupled to the underside of perforated plate 55 and arranged to surround valve standoffs 51-54 and second-bed vent apertures 197 and mate with an inner wall of tube 30 included in filter bed housing 20 as suggested in FIGS. 3, 11, and 13.

Figure 13:
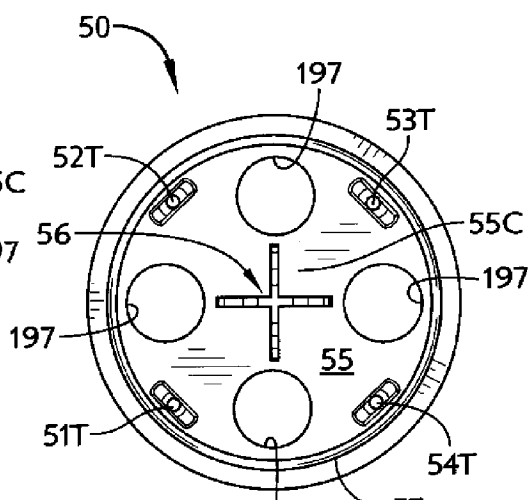
FIG. 13 is a bottom view of the retainer of FIG. 11.
Figure 12:
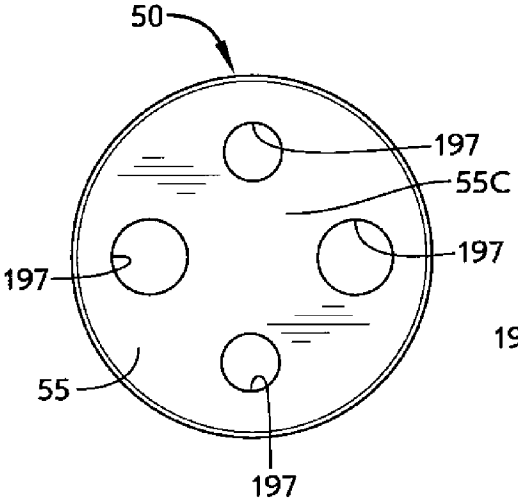
FIG. 12 is a top plan view of the retainer of FIG. 11.

Perforated plate 55 is formed to include four second-bed vent apertures 197 as suggested in FIGS. 11-13. Perforated plate 55 is round in an illustrative embodiment and formed to include a center region 55C surrounded by second-bed vent apertures 197 and coupled to spring mount 56 and a surrounding peripheral region 55P coupled to circular rim 57 as suggested in FIGS. 11 and 13.

Figure 14:
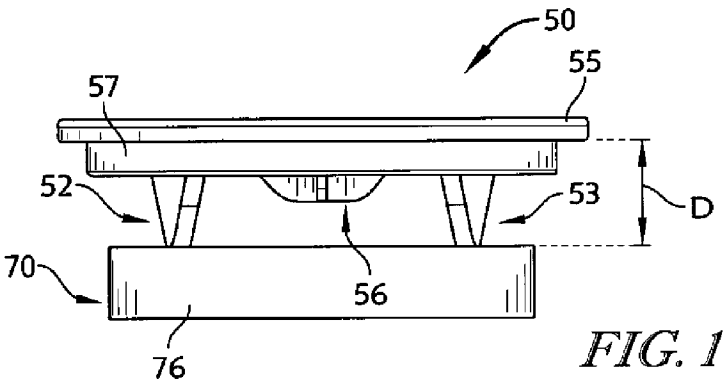
FIG. 14 is a side elevation view of the retainer of FIG. 11 arranged to cause the standoffs included in the perforated retainer to mate with the pressure-relief valve of FIGS. 1-3.

Valve standoffs 51-54 included in perforated retainer 50 cooperate to provide means for mating with pressure-relief valve 70 to maintain the underside of perforated plate 55 at a minimum distance D away from pressure-relief valve 70 during operation of flow-control valve 18 as suggested in FIG. 14. Distal tips 51T-54T of valve standoffs 51-54 are shown in FIG. 13 and arranged to engage a valve plate 72 included in pressure-relief valve 70 when moved to the position shown in FIG. 14.

Pressure-relief valve 70 includes a valve plate 72 arranged to mate with annular valve seat 193 in valve housing 19 as suggested in FIG. 3. Valve plate 72 is formed to include a vapor intake aperture 74 as suggested in FIGS. 3, 16, and 17. A circular outer rim 76 of pressure-relief valve 70 is coupled to an outer peripheral surface of valve plate 72 and arranged to lie in second-bed zone 22 in valve chamber 190 of valve housing 19. A circular inner rim 78 of pressure-relief valve 70 is also coupled to valve plate 72 so as to be surrounded by circular outer rim 76 and to lie in second-bed zone Z2 of valve chamber 190.

Pressure-relief control spring 60 is shown in FIG. 9 and is sized to lie in second-bed zone Z2 of valve chamber 190 of valve housing 19 as shown in FIG. 3. Spring 60 is coiled to assume a frustoconical shape as shown, for example, in FIG. 9. A small-diameter end 62 of spring 60 is arranged to surround spring mount 56 and engage perforated plate 55 when spring 60 is deployed in second-bed zone Z2 of valve chamber 190. A relatively larger large-diameter end 64 of spring 60 is arranged to surround inner rim 78 and engage valve plate 72 when spring 60 is deployed in second-bed zone Z2 of valve chamber 190.

Figure 16:
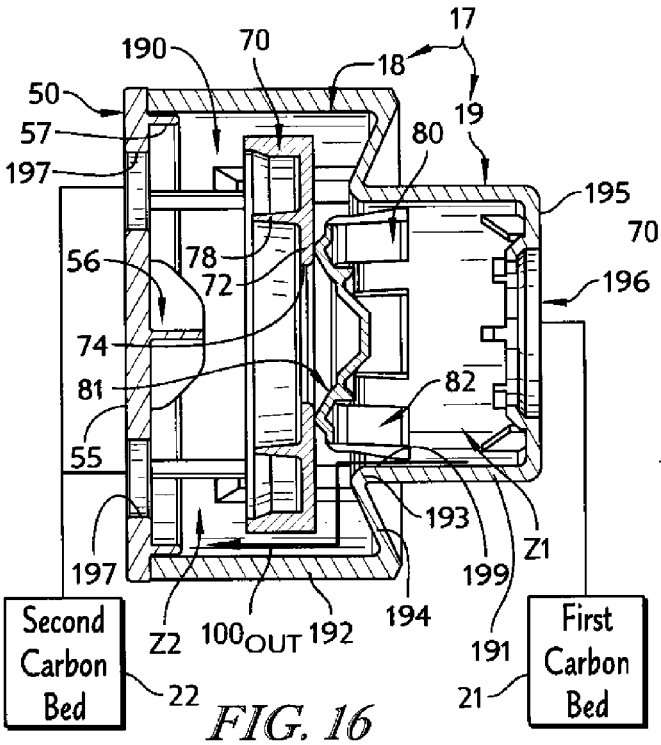
FIG. 16 is a sectional view of the flow-control valve similar to FIG. 3 showing movement of the pressure-relief valve away from the annular valve seat toward the perforated retainer to compress the pressure-relief control spring and open the vapor discharge aperture formed in the valve housing to allow pressurized fuel vapor to flow through the valve chamber formed in the valve housing from the first carbon bed into the second carbon bed.

Vacuum-relief valve 80 includes a closure 81 arranged to mate with an underside of valve plate 72 of pressure-relief valve 70 to close vapor intake aperture 74 as suggested in FIGS. 3 and 16. Vacuum-relief valve 80 also includes a side wall 82 coupled to closure 81 and arranged to extend toward small-diameter plate 195 included in valve housing 19. Side wall 82 comprises six circumferentially spaced-apart panels 821-826 as suggested in FIG. 7. A spring mount 84 is formed on the underside of closure 81 as suggested in FIG. 7.

Vacuum-relief control spring 90 is shown in FIG. 10 and is sized to lie in first-bed zone Z1 of valve chamber 190 of valve housing 19 as shown in FIG. 3. Spring 90 is coiled to assume a frustoconical shape as shown, for example, in FIG. 10. A small-diameter end 92 of spring 90 is arranged to surround spring mount 84 and engage closure 81 when spring 90 is deployed in first-bed zone Z1 of valve chamber 190 as shown in FIG. 3. A relatively larger large-diameter end 94 of spring 90 is arranged to engage small-diameter plate 195 and surround an inner rim 198 coupled to small-diameter plate 195 and located in first-bed zone Z1 of valve chamber 190 as shown in FIG. 3.

Pressure-relief valve 70 and vacuum-relief valve 80 are urged normally by companion springs 60 and 90, respectively, to assume closed positions blocking flow of fuel vapor through valve chamber 190 of valve housing 19 as suggested in FIGS. 1 and 3. Spring 60 yieldably urges pressure-relief valve 70 to mate with annular valve seat 193 of valve housing 19 to close vapor discharge aperture 199 defined by annular valve seat 193. Spring 90 yieldably urges vacuum-relief valve 80 to mate with valve plate 72 of pressure-relief valve 70 to close vapor intake aperture 74 defined by valve plate 72.

High pressure in excess of a predetermined pressure level in first-bed zone Z1 of valve chamber 190 of valve housing 19 results in movement of pressure-relief valve 70 away from annular valve seat 193 toward perforated retainer 50 to compress pressure-relief control spring 60 and open vapor discharge aperture 199 formed in valve housing 19 to allow pressurized fuel vapor to flow along flow path $\mathbf{100}_{OUT}$ through valve chamber 190 formed in valve housing 19 from first carbon bed 21 into second carbon bed 22 as suggested in FIG. 16.

Figure 17:
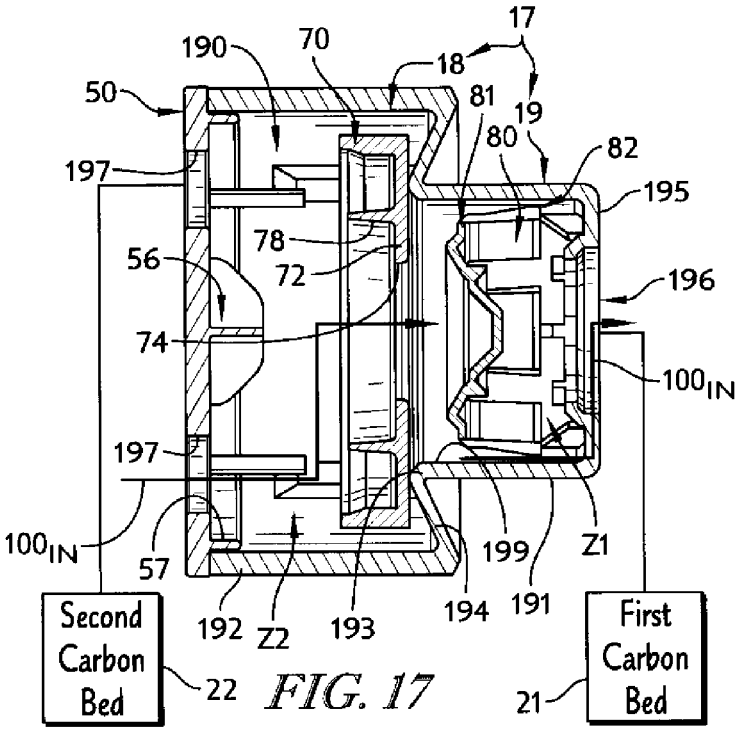
FIG. 17 is a view similar to FIG. 16 showing movement of the vacuum-relief valve away from the pressure-relief valve to compress the vacuum-relief control spring and open the vapor intake aperture formed in the pressure-relief valve to allow atmospheric air to flow through the canister outlet into the filter bed housing to reach the second carbon bed and then flow from the second carbon bed through the valve chamber formed in the valve housing into the first carbon bed in response to application of a vacuum to the canister inlet.

Sufficient negative pressure (i.e., a vacuum) in first-bed zone Z1 of valve chamber 190 of valve housing 19 results in movement of vacuum-relief valve 80 away from pressure-relief valve 70 to compress vacuum-relief control spring 90 and open the vapor intake aperture 74 formed in pressure-relief valve 70 to allow atmospheric air to flow along flow path $\mathbf{100}_{IN}$ through canister outlet 13 into filter bed housing 20 to reach second carbon bed 22 and then flow from second carbon bed 22 through valve chamber 190 formed in valve housing 19 into first carbon bed 21 in response to application of a vacuum to canister inlet 11 as suggested in FIG. 17.

Figure 18:
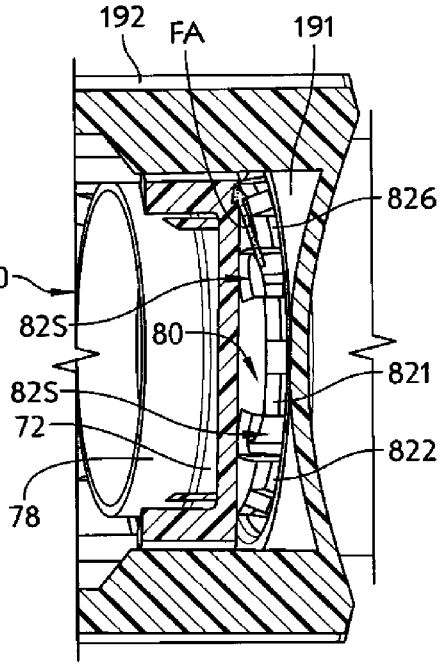
FIG. 18 is a diagrammatic sectional view showing controlled discharge of a small volume of filtered air from the first carbon bed to the second carbon bed through several bypass slots formed in the vacuum-relief valve.

A diagrammatic sectional view showing controlled discharge of a small volume of filtered air FA from first carbon bed 21 to second carbon bed 22 through several bypass slots 82S formed in vacuum-relief valve 80 is shown, for example, in FIG. 18. Each pair of adjacent panels 821-826 of side wall 82 of vacuum-relief valve 80 cooperates to define a bypass slot 82S therebetween as suggested in FIG. 7.

A canister system 10 in accordance with the present disclosure includes charcoal contained in a filter bed housing 20. Filter bed housing 20 includes an inlet 11 adapted to be coupled to a tank vent control system 26 coupled to a fuel tank 24 and to an intake manifold 14 coupled to a vehicle engine 16 as suggested in FIG. 1. Filter bed housing 20 also includes an outlet 13 adapted to communicate with atmospheric air 19 located outside of canister 10.

In illustrative embodiments, canister system 10 includes first and second carbon beds 21, 22 located in spaced-apart relation to one another inside filter bed housing 20 and a vapor flow controller 17 comprising a two-stage bleed emissions flow-control valve 18 located in a space provided in filter bed housing 20 between first and second carbon beds 21, 22 as suggested in FIG. 1. First carbon bed 21 is located near to a canister inlet 11 formed in filter bed housing 20 while second carbon bed 22 is located near to a canister outlet 13 formed in filter bed housing 20. In illustrative embodiments, the vapor flow controller 17 further comprises a valve housing 19 lying between first and second carbon beds 21, 22 and containing the flow-control valve 18 in a valve chamber 190 formed in valve housing 19 as shown, for example, in FIG. 1.

The flow-control valve 18 included in illustrative embodiments of canister system 10 comprises a spring-loaded pressure-relief valve 70 and a spring-loaded vacuum-relief valve 80 as suggested in FIGS. 1-3. Flow-control valve 18 is configured to assume a normally closed position. Flow-control valve 18 is configured to open at the proper time and proper amount when exposed to pressures and vacuums in excess of predetermined levels. This will create higher pressure drop inside first carbon bed 21, slow down the diffusion process, and reduce the migration of hydrocarbons to second carbon bed 22. This will reduce atmospheric discharge of bleed emissions from fuel tank 24 through canister system 10 to the atmosphere 19' through canister outlet 13 as suggested in FIGS. 1 and 3. This, therefore, eliminates or reduces the need to use a separate downstream bleed emissions-capturing honeycomb scrubber (not shown) in combination with the canister system. In the case of hybrid and/or turbocharged engines, when the purge amount is very low, flow-control valve 18 will help to meet stringent bleed emissions requirements with a smaller bleed-emissions-capturing honeycomb scrubber or without heating a bleed-emissions-capturing honeycomb scrubber.

Honeycomb scrubbers are required to adsorb bleed emissions in many cases. Vapor flow controller 17 operates to meet increasingly stringent emission requirements for newer vehicles to provide low bed volume purge without the use of a heated scrubber so as to minimize cost. Vapor flow controller 17 functions to increase canister efficiency so as to remove or reduce the need for a honeycomb scrubber or a heated honeycomb scrubber.

Vapor flow controller 17 is used inside filter bed housing 20 of canister 10 to allow for use between carbon beds 21, 22. Flow-control valve 18 has two stages allowing multiple flow rates required for loading, purging, and diurnal (i.e., daily) venting activities. Having two stages allows canister 10 to load during refueling and purge within customer requirements while adding restriction to the desired carbon bed 21, 22 to increase efficiency of the carbon bed during diurnal loading.

Vapor flow controller 17 is modular, allowing for ease of installation in any canister. Valve housing 19 can be placed in the space provided in interior region 31 of tube 30 between first and second carbon beds 21, 22 to control vapor flow and atmospheric air flow through tube 30. Such flow rates can be changed easily by replacing one vapor flow controller having one set of flow characteristics with another vapor flow controller having another set of flow characteristics. Controller 17 is mechanical, removing need for power and control. Flow-control valve 18 can be tuned for specific applications. Flow-control valve 18 can be electrical or vacuum operated.

Vapor flow controller 17 is configured to be deployed in a filter bed housing of a canister without the need to use restrictor plates. Such restrictor plates restrict flow equally during load, purge, and diurnal activities so as to be less efficient that the two-stage flow-control valve 18 in accordance with the present disclosure. In contrast to restrictor plate canister systems, canister 10 including flow-control valve 18 is operable to meet PZEV and LEVIII emission requirements without using or reducing the need for any separate honeycomb scrubbers.

In the normally closed position, the flow-control valve 18 in illustrative embodiments is formed to include a calibrated bypass to discharge a controlled small volume of filtered air through the canister outlet 13 to the atmosphere 19' as suggested in FIG. 18. Such a limited controlled discharge of pressurized fuel vapor from first carbon bed 21 to second carbon bed 22 and then to the atmosphere 19' through the canister outlet 13 operates to block the buildup of too much pressure in canister system 10.

The invention claimed is:

1. A fuel vapor recovery canister comprising a filter bed housing formed to include an interior region, a canister inlet opening into an upstream portion of the interior region, and a canister outlet opening into a downstream portion of the interior region and communicating with the atmosphere, a hydrocarbon filter located in the interior region of the filter bed housing, the hydrocarbon filter including a first carbon bed positioned to lie in fluid communication with any pressurized fuel vapor and vacuum extant in the upstream portion of the interior region and a second carbon bed positioned to lie in fluid communication with any atmosphere extant in the downstream portion of the interior region and in spaced-apart relation to the first carbon bed to define a flow-controller compartment therebetween, and a two-stage vapor flow controller positioned to lie in the flow-controller compartment in fluid communication with each of the first and second carbon beds of the hydrocarbon filter and configured to provide means for allowing pressurized fuel vapor to flow from the first carbon bed to the second carbon bed to cause hydrocarbons entrained in the pressurized fuel vapor to be deposited on the first and second carbon beds during refueling of a vehicle fuel tank associated with the canister inlet of the filter bed housing and for allowing atmospheric air to be drawn, in sequence, through the canister outlet, second carbon bed, flow-controller compartment, first carbon bed, and canister inlet when a vacuum is applied to the first carbon bed via the canister inlet to cause hydrocarbon deposited on the first and second carbon beds to be entrained in the atmospheric air for delivery to a vehicle engine associated with the canister inlet during a hydrocarbon purge cycle to purge hydrocarbons that had been stored on the first and second carbon beds so that those hydrocarbons can exit the filter bed housing through the canister inlet to be burned in the vehicle engine, wherein the two-stage vapor flow controller includes a valve housing formed to include a valve chamber, a first-bed vent aperture opening into the chamber and lying in fluid communication with the first carbon bed, a second-bed vent aperture opening into the valve chamber and lying in fluid communication with the second carbon bed, and an annular valve seat positioned to lie in the chamber between the first-bed vent aperture and the second-bed vent aperture and arranged to face in a direction toward the second carbon bed to define a first-bed zone in the valve chamber between the first-bed vent aperture and the annular valve seat and a second-bed zone in the valve chamber between the annular valve seat and the second-bed vent aperture, the annular valve seat is formed to include a vapor discharge aperture opening into each of the first-bed zone and the second-bed zone, and the two-stage vapor flow controller includes a pressure-relief valve located in the first-bed zone and formed to include a vapor intake aperture, a pressure-relief control spring arranged to act against the valve housing normally to yieldably urge the pressure-relief valve to engage the annular valve seat, a vacuum-relief valve positioned to lie between the pressure-relief valve and the first-bed vent aperture, and a vacuum-relief control spring arranged to act against the valve housing normally to yieldably urge the vacuum-relief valve to engage the pressure-relief valve to close the vapor intake aperture formed in the pressure-relief valve.

2. The canister of claim 1, wherein the valve housing includes a small-diameter sleeve configured to define the first-bed zone in the valve chamber and a large-diameter sleeve configured to define the second-bed zone in the valve chamber, the large-diameter sleeve being larger than the small-diameter sleeve.

3. The canister of claim 2, wherein the filter bed housing includes a tube defining the interior region of the filter bed housing and containing the first carbon bed, the two-stage vapor flow controller, and the second carbon bed and the valve housing is arranged in the interior region to cause the large-diameter sleeve to mate with an inner surface of the tube and the small-diameter sleeve to be surrounded by and lie in spaced-apart relation to the inner surface of the tube.

4. The canister of claim 2, wherein the filter bed housing includes a tube defining the interior region of the filter bed housing and containing the first carbon bed, the two-stage vapor flow controller, and the second carbon bed and a valve mount coupled to a free end of the small-diameter sleeve to engage the first carbon bed and the vacuum-relief control spring and formed to include the first-bed aperture.

5. The canister of claim 2, wherein the filter bed housing includes a tube defining the interior region of the filter bed housing and containing the first carbon bed, the two-stage vapor flow controller, and the second carbon bed and a perforated retainer coupled to a free end of the large-diameter sleeve to engage the second carbon bed and the pressure-relief control spring and formed to include the second-bed aperture.

6. The canister of claim 5, wherein the perforated retainer includes a perforated plate formed to include the second-bed aperture and at least one valve standoff coupled to the perforated plate and arranged to extend toward the first carbon bed to maintain the pressure-relief valve in spaced-apart relation to the perforated plate during operation of the two-stage flow-control valve.

7. The canister of claim 6, wherein the perforated retainer further includes a rim coupled to the perforated plate and arranged to surround the at least one valve standoff and second-bed vent aperture and mate with an inner wall of the tube included in the filter bed housing.

8. The canister of claim 2, wherein the valve housing further includes a frustoconical plate arranged to interconnect inner ends of the large-diameter sleeve and the small-diameter sleeve and define the annular valve seat.

9. The canister of claim 8, wherein the frustoconical plate is arranged to cause the annular valve seat to be surrounded by the large diameter sleeve and to face toward the perforated retainer.

10. The canister of claim 1, wherein the pressure-relief valve includes a valve plate arranged to mate with the annular valve seat, an outer rim coupled to an outer peripheral surface of the valve plate and arranged to lie in the second-bed zone in the chamber of the valve housing, a circular inner rim coupled to the valve plate so as to be surrounded by the outer rim and to lie in the second-bed zone of the chamber, a first end of the pressure-relief control spring is arranged to engage the perforated plate, and a second end of the pressure-relief control spring is arranged to surround the inner rim and engage the valve plate.

11. The canister of claim 10, wherein a diameter of the first end of the spring is less than a diameter of the second end of the spring.

12. The canister of claim 1, wherein the vacuum-relief valve includes a closure arranged to mate with an underside of the pressure-relief valve normally to close the vapor intake aperture formed in the pressure-relief valve and a side wall coupled to the closure and formed to include several panels coupled to the closure for independent movement relative to the closure and to one another, a first end of the vacuum-relief control spring is arranged to engage the valve mount, and a second end of the vacuum-relief control spring is arranged to engage the closure and to be surrounded by the side wall of the vacuum-relief valve.

13. A fuel vapor recovery canister comprising a filter bed housing including an inlet adapted to be coupled to a tank vent control system coupled to a fuel tank and to an intake manifold coupled to a vehicle engine and an outlet adapted to communicate with atmospheric air located outside of the canister, a hydrocarbon filter including first and second carbon beds located in spaced-apart relation to one another inside the filter bed housing, the first carbon bed being located near to the inlet, the second carbon bed being located near to the outlet, and a vapor flow controller located in the filter bed housing in a space provided between the first and second carbon beds, the vapor flow controller including a two-stage bleed emissions flow-control valve configured to provide means for normally blocking flow of fuel vapor and atmospheric air through the space provided between the first and second carbon beds as long as pressure and vacuum extant in the first carbon bed remains below predetermined threshold levels to minimize atmospheric discharge of bleed admissions from a fuel tank associated with the filter bed housing and for allowing flow of fuel vapor and atmospheric air through the space provided between the first and second carbon beds once pressure and vacuum extant in the first carbon bed equals or exceeds the predetermined threshold levels, wherein the vapor flow controller includes a valve housing interposed between the first and second carbon beds and formed to include a vapor discharge aperture interconnecting the first and second carbon beds in fluid communication with one another, a spring-loaded pressure-relief valve arranged normally to close the vapor discharge aperture to block flow of fuel vapor through the vapor-discharge aperture, and a spring-loaded vacuum-relief valve arranged normally to close a vapor-intake aperture formed in the pressure-relief valve to block flow of fuel vapor from the second carbon bed to the first carbon bed through the vapor-intake aperture when the vapor-discharge aperture formed in the valve housing is closed by the spring-loaded pressure-relief valve.

14. The canister of claim 13, wherein the valve housing further includes a small-diameter sleeve adjacent to the first carbon bed and configured to include a first bed zone in fluid communication with the first carbon bed and a large-diameter sleeve adjacent to the second carbon bed and configured to include a second bed zone in fluid communication with the second carbon bed and in fluid communication with the first bed zone via the vapor-discharge aperture formed in the valve housing, the spring-loaded pressure-relief valve is arranged to lie in the second bed zone, and the spring-loaded vacuum-relief valve is arranged to lie in the first bed zone when the spring-loaded vacuum-relief valve is moved by vacuum extant in the first carbon bed to disengage the spring-loaded pressure-relief valve and open the vapor-intake aperture formed in the spring-loaded pressure-relief valve and to extend through the vapor-discharge aperture formed in the valve housing and partly into the second bed zone when the spring-loaded pressure-relief valve is moved by pressure extant in the first carbon bed to open the vapor-discharge aperture formed in the valve housing, the large-diameter sleeve being larger than the small-diameter sleeve.

15. The canister of claim 14, wherein the valve housing further includes a plate arranged to interconnect inner ends of the large-diameter sleeve and the small-diameter sleeve to define an annular valve seat and the annular valve seat is arranged to form a perimeter boundary of the vapor-discharge aperture and engage the spring-loaded pressure-relief valve to block vapor flow through the vapor-discharge aperture.

16. The canister of claim 13, wherein the valve housing includes a small-diameter sleeve configured to define a first-bed zone located in the valve chamber and arranged to lie in fluid communication with the first carbon bed and a large-diameter sleeve configured to define a second-bed zone located in the valve chamber and arranged to lie in fluid communication with the second carbon bed, the large-diameter sleeve being larger than the small-diameter sleeve.

17. The canister of claim 16, wherein the filter bed housing includes a tube defining the interior region of the filter bed housing and containing the first carbon bed, the two-stage vapor flow controller, and the second carbon bed and the valve housing is arranged in the interior region to cause the large-diameter sleeve to mate with an inner surface of the tube and the small-diameter sleeve to be surrounded by and lie in spaced-apart relation to the inner surface of the tube.

18. A fuel vapor recovery canister comprising a filter bed housing including an inlet adapted to be coupled to a tank vent control system coupled to a fuel tank and to an intake manifold coupled to a vehicle engine and an outlet adapted to communicate with atmospheric air located outside of the canister, a hydrocarbon filter including first and second carbon beds located in spaced-apart relation to one another inside the filter bed housing, the first carbon bed being located near to the inlet, the second carbon bed being located near to the outlet, a spring-loaded pressure-relief valve configured to normally to close a vapor discharge aperture interconnecting the first and second carbon beds to block flow of fuel vapor through the vapor-discharge aperture, and a spring-loaded vacuum-relief valve configured normally to close a vapor-intake aperture interconnecting the first and second carbon beds, the vapor-intake aperture being formed in the pressure-relief valve.

19. The canister of claim 18, wherein the vapor flow controller includes a valve housing interposed between the first and second carbon beds, the valve housing formed to include the vapor discharge aperture.

20. The canister of claim 18, wherein the spring-loaded pressure-relief valve is mounted for movement along an axis to selectively block or allow flow of fuel vapor through the vapor-discharge aperture and the spring-loaded vacuum-relief valve is mounted for movement along the axis to selectively block or allow flow of fuel vapor from the second carbon bed to the first carbon bed through the vapor-intake aperture.

* * * * *